United States Patent [19]

Roller

[11] 4,298,048

[45] Nov. 3, 1981

[54] ROLL-UP DIVIDER

[76] Inventor: Max F. Roller, 7230 N. Keystone, Lincolnwood, Ill.

[21] Appl. No.: 780,529

[22] Filed: Mar. 23, 1977

[51] Int. Cl.[3] ..... A47G 5/02; E06B 9/204

[52] U.S. Cl. ..... 160/243; 160/310

[58] Field of Search ..... 160/243, 310, 191, 85

[56] References Cited

U.S. PATENT DOCUMENTS

| | | | |
|---|---|---|---|
| 95,219 | 9/1869 | Fuller | 160/85 |
| 215,374 | 5/1879 | Lefebure | 160/243 |
| 1,550,237 | 8/1925 | Beckman | 160/391 |
| 3,006,352 | 10/1961 | Hozak | 160/310 |
| 3,306,345 | 2/1967 | Youngs | 160/243 |
| 3,580,321 | 5/1971 | Root | 160/310 |
| 3,900,063 | 8/1975 | Roller | 160/310 |

*Primary Examiner*—Rodney H. Bonck

*Attorney, Agent, or Firm*—Hill, Van Santen, Steadman, Chiara & Simpson

[57] ABSTRACT

A roll up divider has a flexible curtain suspended from its top marginal edge and carrying a cylindrical roll at its bottom marginal edge upon which the curtain is wound and unwound. A plurality of spaced apart webs or belts embrace the curtain as a part of a frictional drive. Each of the belts is wound upon a motor driven shaft and each is provided with a fair lead as a guide mechanism to prevent wandering of the belt as it is being wound.

3 Claims, 8 Drawing Figures

VI
34
36
40
46
50
50'
54'
60'
58
60
54
30'
26'
48
52
56
30'
VI
40
40
36
46
66
64
48
58
50
54
30

26
30
30
50
58
78
74
76
90
88
84

48
58
50
78
82
74
88
86
76
80
84

22
24
28

ROLL-UP DIVIDER

BACKGROUND OF THE INVENTION

1. Field of the Invention

This invention relates to roll up dividers, and is particularly concerned with such dividers which are rolled up from the bottom under the influence of a frictional drive.

2. Description of the Prior Art

Those skilled in the art will appreciate that there are many awning systems in which the flexible awning material is rolled up and down about a cylindrical member which is attached to its lower marginal edge, under the influence of one or more ropes or cords, hereinafter simply referred to as strands. Those skilled in the art will also appreciate that each strand causes a compacting and an indentation of the material at the strand location due to the weight of the curtain apparatus supported by the strand. Upon unrolling, these indentations appear as strips of wrinkles over the entire height of the divider curtain. Not only does this provide an unsightly partition, but with increasing size of divider curtains, and thus increasing weight of such curtains, the wrinkles are intensified and, as additional support strands are needed to support such weight, corresponding greater numbers of strips of wrinkles are formed.

SUMMARY OF THE INVENTION

It is the primary object of the present invention to provide a frictionally driven divider which rolls up from the bottom and which is free of or has a minimum of wrinkling, particularly in the area of large partitioning or divider curtains in which there is a great deal of weight in the supported material.

Heretofore, in order to support additional weight, additional strands were employed. As mentioned above, however, this led to increased numbers of vertical strips of wrinkles in the curtain material. In order to eliminate greater numbers of vertical strips of wrinkles, one could resort to, as I have done in the present invention, using a lesser number of strands and increasing the width of the strands to the point where the same become belts or webs in order to distribute the supported weight over a larger area. This structure, which is a feature of the present invention, would minimize or eliminate wrinkling, but those skilled in the art have not employed this technique in that, heretofore, the use of supporting webs presented a problem with the curtain drive mechanism in that belts or webs could not be wound upon themselves in that they tend to wander transversely to the direction of belt movement because of differing biases and material tolerances of the belts. I have found, however, a simple technique which utilizes simple apparatus for ensuring that such a belt is wound upon itself without wandering transversely of its axis of rotation.

According to the invention, a roll up divider curtain is supported so as to depend from its top marginal edge and carries, attached to its bottom marginal edge, a cylindrical member upon which the divider curtain is wound. At least one web supports the cylindrical member and the curtain material and provides a frictional drive for winding the material about the cylindrical member.

Each of the webs has one end attached to an overhead support adjacent the upper marginal edge of the curtain, and the other end attached to a rotatable shaft which is also located overhead and spaced from the upper marginal edge of the curtain. Each belt is also provided with a fair lead, also located overhead, which receives the belt therethrough and prevents movement of the belt transversely of its winding and unwinding direction.

The fair lead includes a structure which defines a slot for receiving the belt therethrough and a roller over which the belt is carried. The fair lead may also advantageously include a pair of rollers which extend into the slot and rollingly engage opposite edges of the belt.

The rotatable shaft is driven by a motor and the belt is wound directly thereon. In addition, a pair of spaced members may be carried on the shaft, in the form of a spool, to further aid proper tracking of the belt. However, the use of a spool per se does not provide proper tracking without the use of additional guide structure, such as a fair lead, and should be avoided in that a properly guided belt, according to the present invention, can be wound directly on a shaft and the spool material adds weight and requires additional overhead materials.

BRIEF DESCRIPTION OF THE DRAWINGS

Other objects, features and advantages of the invention, its organization, construction and operation will be best understood from the following detailed description taken in conjunction with the accompanying drawings, on which:

FIG. 6 is a sectional view taken substantially along the parting line VI—VI in FIG. 5 showing, in elevation, the fair lead structure;

DESCRIPTION OF THE PREFERRED EMBODIMENTS

Figures 1, 2, 3, 4:
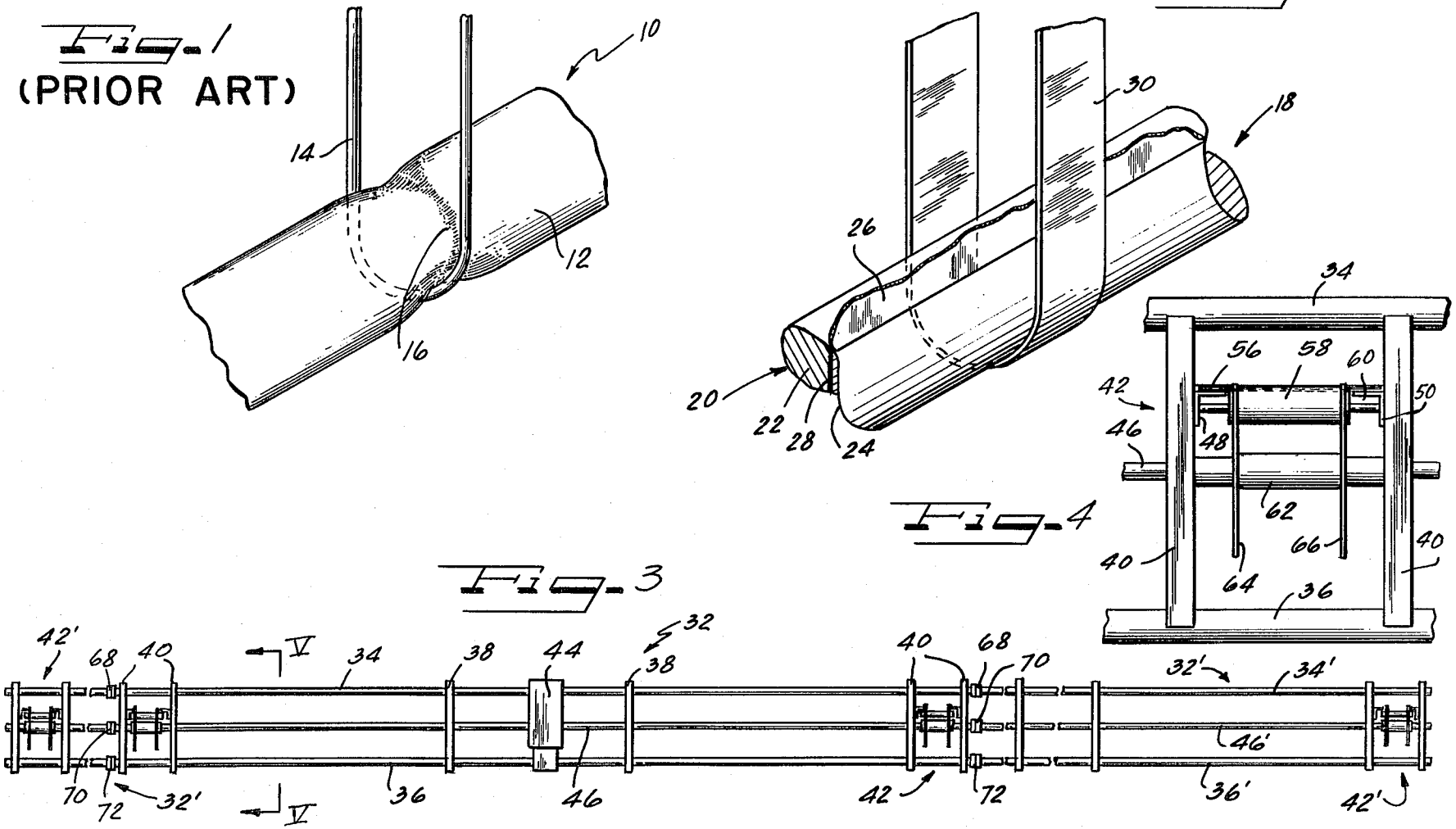
FIG. 1 (PRIOR ART)
FIG. 1 is a perspective view of a portion of a prior art roll up divider curtain.
FIG. 2 is a view similar to that of FIG. 1 illustrating a belt supported curtain and a two-piece cylindrical member on which the curtain is rolled.
FIG. 3 is a top plan view of the overhead drive and support structure for a flexible roll up divider constructed in accordance with the present invention.
FIG. 4 is a top plan view of one of the fair laid structures illustrated in FIG. 3 and showing the elements thereof in greater detail.

Referring first to FIG. 1, a roll up divider curtain is generally illustrated at 10 as comprising curtain material 12 wound upon a cylindrical member (not shown) and supported by a strand 14 which, because of the weight of the supported material, causes an indentation 16 which, when the curtain is unrolled, appears as a vertical strip of wrinkled material. In FIG. 1, the portion of the material extending for attachment to an overhead support has been omitted in order to better illustrate the strand 14 and the indentation 16.

Referring to FIG. 2, a roll up divider curtain is generally illustrated at 18 as comprising a cylindrical member 20 constructed from a pair of elongate members 22 and 24 each having a semi-circular cross section and therefore planar surfaces which are joined together at 28 to secure the bottom marginal edge of a flexible curtain 26 therebetween. The cylindrical member 20 and the curtain 26 are supported by a web or belt 30 so as to distribute the supported weight over a larger area and minimize or eliminate wrinkling.

Referring to FIGS. 3–6, a roll up divider curtain installation is generally illustrated as comprising an overhead support and driving system 32 which includes a pair of elongate members 34 and 36, here in the form of pipes, which are held spaced apart by a plurality of members 38, such as angle irons. An electric motor 44, such as a single reduction gearmotor sold under the designation Winsmith #5 MCT, is supported between the transverse members 38 to rotate a shaft 46.

Figures 4, 5, 7, 8:
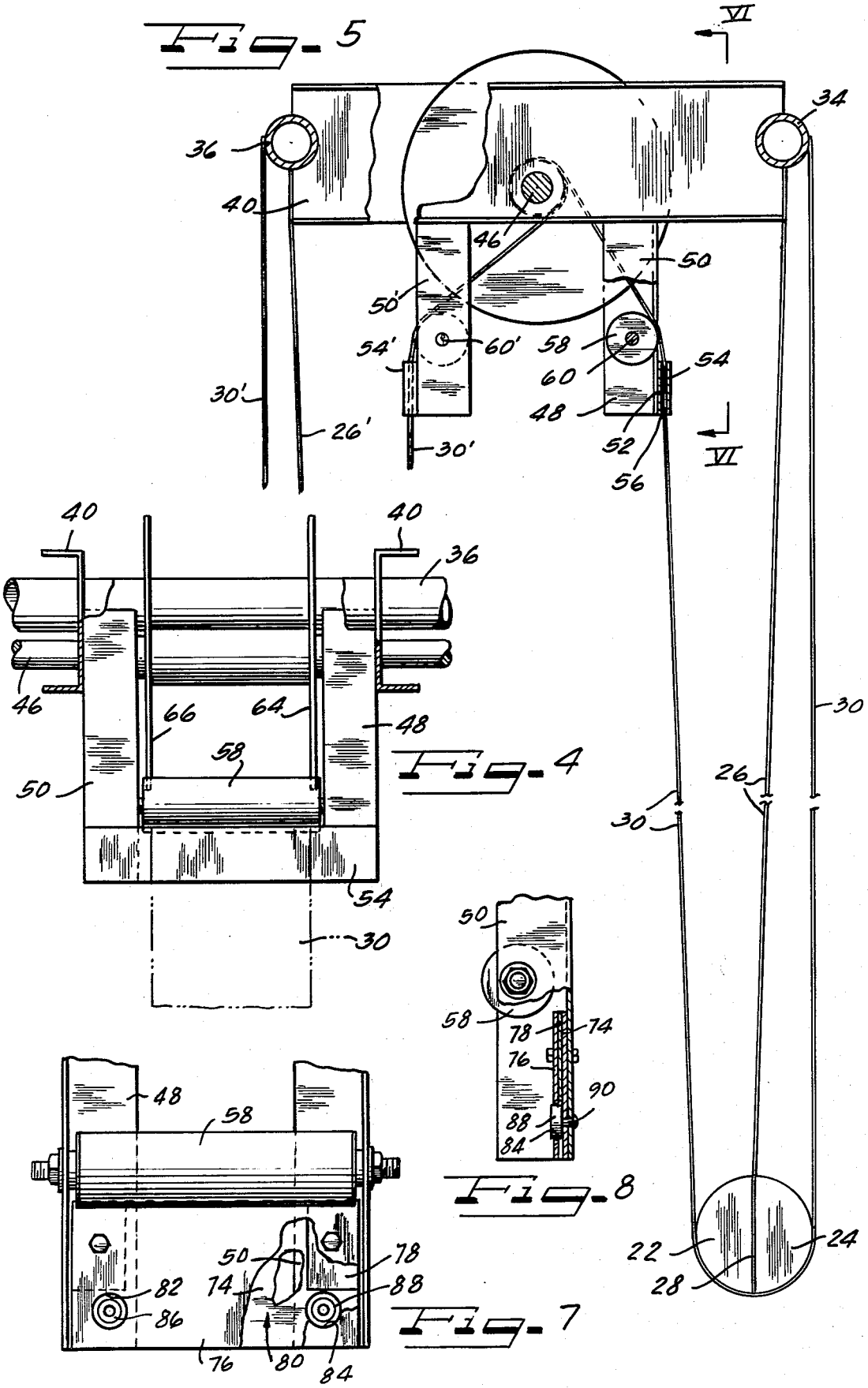
FIG. 5 is a sectional view of the apparatus of FIG. 3 taken substantially along the parting line V—V.
FIG. 7 is a view similar to FIG. 6 of another fair lead structure.
FIG. 8 is an end view of the apparatus illustrated in FIG. 7, as viewed generally in the direction VIII—VIII, and shown partially broken away to better illustrate the slot and roller structure.

Spaced outboard of each of the cross members 38 is a pair of other cross members 40, such as channel irons, which are secured to the elongate members 34 and 36, such as by welding, with each pair of members 40 supporting a fair lead 42, best illustrated in FIGS. 4–6. Each of the fair leads 42 comprises a pair of members 48 and 50, which depend from respective ones of the transverse members 40 and which have secured to their lower distal ends a slot structure comprising a pair of spaced plates 52 and 54 which define a slot 56 therebetween for receiving the belt 30 therethrough. The members 48 and 50 also support a roller 58 which is rotatably mounted in bearings (not shown) on a shaft 60.

As mentioned above, the belt 30 winds upon itself about the shaft 46 and in some applications, a spool, here illustrated by the circular plates 64 and 66 and a tube 62 mounted on the shaft 46, may be utilized. In most applications, however, the spool 62, 64, 66 is not necessary.

Referring back to FIG. 3, the structure previously disclosed is now referred to as a center unit. The center unit, for one application, is 18 feet in length with the motor 44 centered, the transverse members 38 spaced apart 4 feet, the transverse members 40 of each pair spaced 11 inches and the inboard member of each pair spaced 1 foot from the respective end of the center unit. The length of the center unit may be extended in 18 foot sections by end units 32', each of which includes a fair lead structure 40', 42' of similar construction and spacing as fair lead structures 40, 42 and a plurality of transverse members 38 equally spaced between the center unit 32 and the inboard member 40'. The elongate members 34' and 36' are connected to the elongate members 34 and 36 by couplings 68 and 72 and the rotatable shaft extension 46' is connected to the rotatable shaft 46 by a coupling 70. With a center unit 32 and a pair of end units 32', a span of at least 54 feet may be divided with the curtain supported by four belts. This structure, of course, may be extended with additional end units and there is no limit in length so that the same apparatus is equally applicable to gym dividers, aircraft hanger doors and aircraft hanger wind screens.

A typical installation, using 10 foot sections instead of the aforementioned 18 foot sections, for a 30 foot high by 100 foot area would typically lift 800 pounds. There would be ten units with belts spaced at 5 foot intervals. If a steel tube is used for the cylindrical element 20, rather than the illustrated wood cylinder, 500 pounds would be attributed to the tube.

Referring to FIGS. 7 and 8, a preferred embodiment of the fair lead structure is illustrated in which the elements 48, 50 and 58 are substantially the same as illustrated in FIGS. 4–6. In FIGS. 7 and 8, however, the slot structure is illustrated as comprising a first plate 74 which is spaced from a second plate 76 by a pair of spacer plates 78 to define a slot 80 for receiving a belt therethrough. The plate 76 includes a pair of apertures 82 and 84 which receive respective rollers 86,88 therein, the rollers being mounted to the plate 74 and the respective members 48 and 50, as indicated at 90. The rollers 86 and 88 may be constituted by, for example, Kilian bearings #STB 14-389 NT. The rollers 86 and 88 extend inwardly beyond the inside edges of the spacer plates 78 to engage the respective edges of the belt as it runs through the slot 80 and therefore prevent wear on the edges of the belt.

Referring again to FIG. 5, a dual structure is illustrated whereby a pair of flexible curtains may be provided so as to have an air gap therebetween for purpose of insulation, both sound insulation and thermal insulation. The structure is identical to that discussed above in connection with FIG. 5, with the exception that there is a symmetrically arranged curtain 26' with an appropriate number of belts 30' and a corresponding number of fair lead structures (50', 54' 60'). It should be noted that the belts 30 and 30' interwind upon one another in the same manner as a single belt 30 would wind upon itself. It should be noted, however, that it is not necessary for the belts 30 and 30' to be transversely aligned with each other and that the belts could be staggered so that each winds upon itself at a separate section of the shaft 46.

In order for one skilled in the art to have a better understanding of the sizes of elements illustrated herein, the following tabular example is provided based on 18 foot center and end units.

EXAMPLE (Span and Curtain)

| | |
|---|---|
| Length of Span | 54 feet |
| Height of Span | 25–30 feet |
| Weight of Curtain | 400 lbs. |
| Curtain Material | Vinyl Coated Polyester |
| Units | 1 Center, 18 feet<br>2 End, 36 feet |
| Fair Leads and Belts | 4 |
| Belt Material and Size | Stable Preheat-Set Vinyl Coated Polyester, 5 inches wide |

Overhead Structure

| Element | Size |
|---|---|
| 34,36 | 2" D × 18' Fence Pipe |
| 38 | MC 8 × 8.5 Angle |
| 40 | 5 × 1½ × 21 Channel Ga.11 |
| 44 | Winsmith #5 MCT |
| 46 | 1' × 18' Shaft |
| 48,50 (FIG. 4) | 2 × 2 × 150 × 12 Angle |
| (FIG.7) | 2 × 2 × ⅛ × 12 Angle |
| 52,54 | 2 × 10½ Plate |
| 58 (FIG. 4) | 2" D. × 6½" Tube |
| 58 (FIG. 7) | 2" D. × 7.3125" Tube<br>Schatz Bearings #CS-2664 |
| 74,76 | 7½ × 4 × ⅛ Plate |
| 78 | 2.875 × 1.375 Plates |
| 86,88 | Kilian Bearing #STB 14-389 NT |
| 90 | 8-32 Thd. Screws |

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A roll up divider comprising:

a flexible curtain having top and bottom marginal edges;

a cylindrical member attached to the bottom marginal edge for winding and unwinding said curtain;

a web embracing said cylindrical member with curtain material, when wound thereon, intermediate said web and said cylindrical member;

support means fixedly supporting one end of said web and said top marginal edge of said curtain at an overhead location;

a rotatably mounted shaft spaced from said top marginal edge at another overhead location, the other end of said web attached to said shaft;

drive means connected to said shaft and operable to rotate said shaft in either direction to wind said web thereon and unwind said web therefrom to cause a corresponding winding of said curtain about said cylindrical member and unwinding of said curtain from said cylindrical member; and a fair lead for contacting and guiding said web so that said web is prevented from wandering and winds upon itself, said fair lead comprising a roller spaced from said shaft and parallel thereto for rollingly engaging and supporting said web, and a pair of other rollers mounted parallel to each other to engage and guide the edges of said web.

2. A roll up divider comprising:

a flexible curtain having top and bottom marginal edges;

a cylindrical member attached to the bottom marginal edge for winding and unwinding said curtain;

a web embracing said cylindrical member with curtain material, when wound thereon, intermediate said web and said cylindrical member;

support means fixedly supporting one end of said web and said top marginal edge of said curtain at an overhead location;

a rotatably mounted shaft spaced from said top marginal edge at another overhead location, the other end of said web attached to said shaft;

drive means connected to said shaft and operable to rotate said shaft in either direction to wind said web thereon and unwind said web therefrom to cause a corresponding winding of said curtain about said cylindrical member and unwinding of said curtain from said cylindrical member; and a fair lead for contacting and guiding said web so that said web is prevented from wandering and winds upon itself, said fair lead comprising a roller spaced from said shaft and parallel thereto for rollingly engaging and supporting said web, means defining a slot receiving said web therethrough adjacent said roller, and means in said slot for engaging and guiding the edges of the web, said slot defining means comprising a pair of spaced apart members, and the last-mentioned means comprising a pair of other rollers mounted to extend between said spaced apart members and into the slot to engage the edges of the web.

3. In a method of rolling up a curtain from the bottom, which curtain has a fixed top marginal edge and a roll connected to the bottom marginal edge for winding the curtain thereon, the improvement comprising the steps of:

supporting and frictionally embracing the roll and the curtain material wound thereon with at least one belt of a width which does not compress the curtain material to an extent to cause wrinkling of the curtain material;

winding the belt from one end thereof upon itself in continuous convolutions, the frictional engagement causing the roll to rotate and wind the curtain thereon; and guiding the belt as it is being wound to prevent transverse wandering movement of the belt with respect to its direction of winding movement to ensure coextensive continuous convolutions of the belt upon itself, including moving the belt through a slot which has end walls that limit transverse movement of the belt and rollingly engaging the edges of the belt adjacent the end walls within the slot.

* * * * *